US011073779B2

(12) United States Patent
Obata et al.

(10) Patent No.: US 11,073,779 B2
(45) Date of Patent: Jul. 27, 2021

(54) IMAGE HEATING APPARATUS AND IMAGE FORMING APPARATUS

(71) Applicant: CANON KABUSHIKI KAISHA, Tokyo (JP)

(72) Inventors: Seiji Obata, Mishima (JP); Takafumi Suzuki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/891,441

(22) Filed: Jun. 3, 2020

(65) Prior Publication Data

US 2020/0387097 A1 Dec. 10, 2020

(30) Foreign Application Priority Data

Jun. 7, 2019 (JP) ..... JP2019-107310

(51) Int. Cl.
*G03G 15/20* (2006.01)

(52) U.S. Cl.
CPC ..... *G03G 15/2053* (2013.01)

(58) Field of Classification Search
CPC ..... G03G 15/206; G03G 15/2017; G03G 15/2032; G03G 15/2053; G03G 2215/2003
See application file for complete search history.

(56) References Cited

U.S. PATENT DOCUMENTS

2017/0293246 A1 10/2017 Iketani

FOREIGN PATENT DOCUMENTS

JP H04104282 A 4/1992
JP 2016102985 A 6/2016
JP 2017187702 A 10/2017

OTHER PUBLICATIONS

JP 2016102985 English machine translation, Mizuta et al., Jun. 2, 2016 (Year: 2016).*

* cited by examiner

*Primary Examiner* — Thomas S Giampaolo, II

(74) *Attorney, Agent, or Firm* — Rossi, Kimms & McDowell LLP

(57) ABSTRACT

An image heating apparatus including: a first rotating member; a second rotating member which forms a nip portion between the first rotating member and the second rotating member; a frame member which supports the second rotating member; a biasing member which biases the first rotating member toward the second rotating member; a moving member which supports the biasing member at an end portion of the biasing member on an opposite side to a side of an end portion where the first rotating member is arranged; and an adjustment member which comes into contact with the moving member and which adjusts a position of the moving member with respect to the frame member, wherein a contact portion between the moving member and the adjustment member in the biasing direction regulates relative movement of the moving member and the adjustment member in a direction perpendicular to the biasing direction.

12 Claims, 10 Drawing Sheets

IMAGE HEATING APPARATUS AND IMAGE FORMING APPARATUS

BACKGROUND OF THE INVENTION

Field of the Invention

The present invention relates to image heating apparatuses such as a fixing apparatus mounted to an image forming apparatus including a printer, a copier, or the like which adopts an electrophotographic system or an electrostatic recording system, a gloss imparting apparatus which reheats a toner image fixed to a recording material in order to improve a gloss value of the toner image, and the like.

Description of the Related Art

A fixing apparatus which represents an example of the image heating apparatus described above and which is mounted to an image forming apparatus fixes an unfixed toner image on a recording material by sufficiently heating and melting the unfixed toner image between two rotating members (a nip portion), subsequently uniformly flattening the unfixed toner image using a smooth member, and sandwiching and transporting the unfixed toner image. While fixing the unfixed toner image in a preferable manner requires that proper pressure be applied to the nip portion, set pressure may not be attained due to factors such as variability in a biasing force of a spring (an elastic member) for biasing pressure and tolerance of respective parts constituting the fixing apparatus. In addition, generally, springs for biasing pressure to the nip portion are independently provided at both ends of the nip portion, and from the perspective of precision of parts, it is difficult to make pressure at both ends exactly the same. Once a balance between loads applied to the nip portion is lost, abrasion of fixing parts accelerates and a lifespan of the apparatus can no longer be extended. Furthermore, for the purpose of stabilizing the load balance, expensive and highly accurate parts are used in order to prevent a decline in image quality, to prevent an occurrence of wrinkles of a recording material, and the like.

Japanese Patent Application Laid-open No. 2016-102985 describes a fixing apparatus that enables pressure applied to a nip portion to be finely adjusted.

SUMMARY OF THE INVENTION

The fixing apparatus described in Japanese Patent Application Laid-open No. 2016-102985 has a cylindrical film as a first rotating member and a pressure contact roller as a second rotating member that comes into contact with the cylindrical film, and the pressure contact roller is rotatably provided on a supporting frame. Furthermore, the fixing apparatus is provided with: a lever member which is rotatably provided with respect to the supporting frame and which biases the film with respect to the pressure contact roller; and a spring which applies a biasing force to the lever member. The fixing apparatus further includes: a moving member which is movably provided in a biasing direction with respect to the supporting frame at an end portion of the spring on an opposite side to an end portion on a side of the film (the first rotating member) of the spring and which supports the spring; and a regulating member which is movably fixed with respect to the supporting frame and which fixes a position of the moving member by coming into contact with the moving member. Therefore, while nip pressure between the film and the pressure contact roller can be adjusted, when a shape of a contact portion between the moving member and the regulating member becomes distorted or a support position of the spring by the moving member and a contact position between the moving member and the regulating member shift and become unstable, postures of the moving member, the spring, and the lever become tilted. In addition, the tilting causes the parts to come into contact with other parts such as the supporting frame. When such contact occurs during fine adjustment of pressure, a loss is created in spring pressure to be biased, making it difficult to perform the adjustment in an accurate manner. Therefore, such situations are dealt with in a time-consuming manner by repetitively performing adjustments and reducing a speed at which an adjustment is performed so that parts do not become tilted.

An object of the present invention is to provide, in an image heating apparatus including a mechanism for finely adjusting pressure applied to a nip portion, an image heating apparatus and an image forming apparatus which enable pressure to be adjusted in a short period of time without incurring pressure loss.

In order to achieve the object described above, an image heating apparatus according to the present invention which heats an image formed on a recording material includes:

a first rotating member;

a second rotating member which comes into contact with the first rotating member and which forms a nip portion that sandwiches the recording material between the first rotating member and the second rotating member;

a frame member which rotatably supports the second rotating member;

a biasing member constituted by an elastic member which biases the first rotating member toward the second rotating member;

a moving member which is provided so as to be movable in a biasing direction of the biasing member with respect to the frame member at an end portion of the biasing member on an opposite side to a side of an end portion of the biasing member where the first rotating member is arranged and which supports the biasing member; and an adjustment member which comes into contact with the moving member in the biasing direction and which is used to adjust a position of the moving member in the biasing direction with respect to the frame member, wherein a contact portion between the moving member and the adjustment member in the biasing direction has a regulating shape that regulates relative movement of the moving member and the adjustment member in a direction perpendicular to the biasing direction.

Furthermore, in order to achieve the object described above, an image forming apparatus according to the present invention includes:

an image forming portion which forms an image on a recording material; and a fixing portion which fixes an image formed by the image forming portion to the recording material, wherein the fixing portion is the above mentioned image heating apparatus.

As described above, according to the present invention, in an image heating apparatus including a mechanism for finely adjusting pressure applied to a nip portion, an image heating apparatus and an image forming apparatus which enable pressure to be adjusted in a short period of time without incurring pressure loss can be provided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
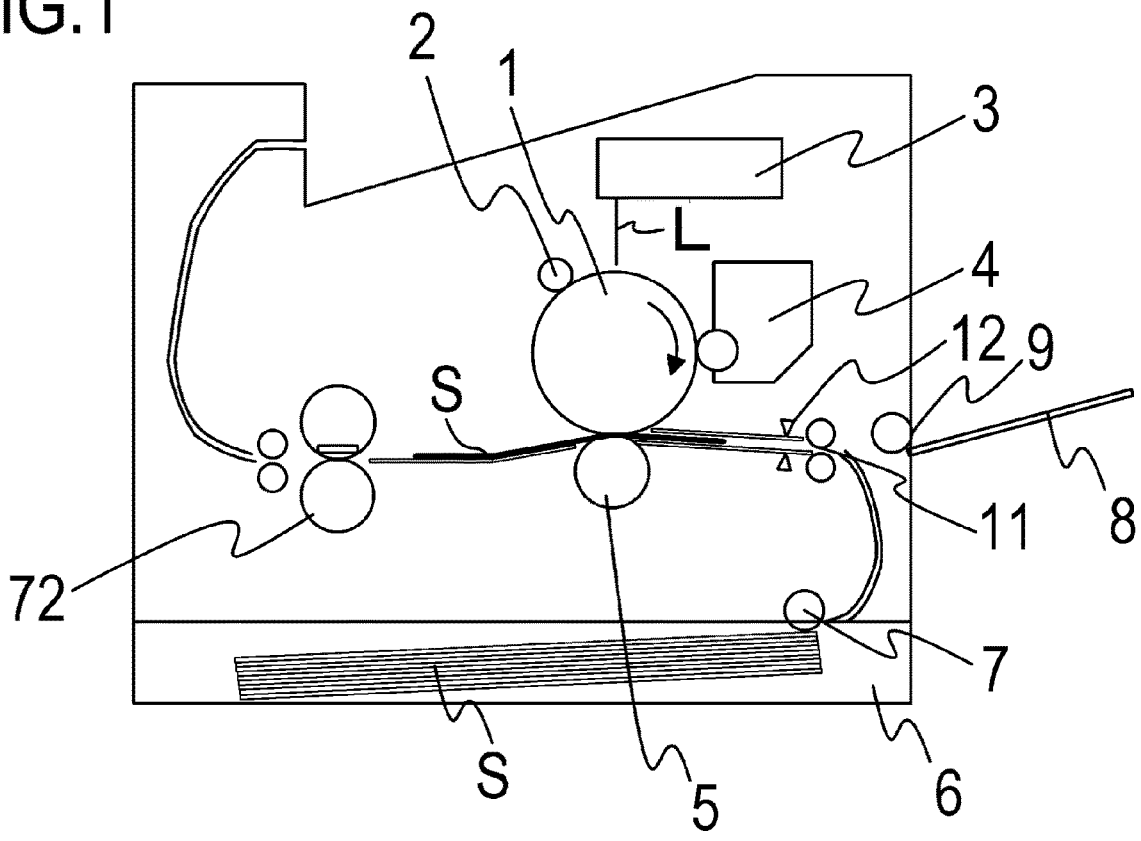
FIG. 1 is a schematic configuration diagram of an image forming apparatus.

Hereinafter, a first embodiment of the present invention will be described with reference to the drawings. First, a sectional view illustrating a configuration of an entire image forming apparatus according to the present invention is shown in FIG. 1. A photosensitive drum 1 is rotationally driven in a direction depicted by an arrow, and a surface of the photosensitive drum 1 is uniformly charged by a charging roller 2 as a charging apparatus. Next, scanning exposure by a laser beam L of which ON/OFF is controlled in accordance with image information by a laser scanner 3 is performed and an electrostatic latent image is formed (a latent image forming process). In addition, a developing apparatus 4 causes toner to adhere to the electrostatic latent image and develops a toner image on the photosensitive drum 1 (a developing process). Subsequently, the toner image formed on the photosensitive drum 1 is transferred at a transfer nip portion which is a pressure contact portion between a transfer roller 5 and the photosensitive drum 1 to a recording material S which is a heated member having been transported by a paper feeding roller 7 at a prescribed timing from a paper feeding cassette 6 (a transfer process). At this point, the timing is adjusted by detecting a leading end of the recording material transported by a transporting roller 11 by a top sensor 12 so that an image formation position of the toner image on the photosensitive drum 1 and a write start position of the leading end of the recording material S match each other. The recording material S having been transported to the transfer nip portion at a prescribed timing is sandwiched and transported by the photosensitive drum 1 and the transfer roller 5 by a constant pressurizing force. The configuration up to the formation of an unfixed toner image on the recording material S described above corresponds to the image forming portion in the image forming apparatus according to the present invention. The recording material S to which the unfixed toner image has been transferred is transported to a fixing apparatus (an image heating apparatus) 72 as the fixing portion and the toner image is heated and fixed to the recording material S at the fixing apparatus 72. Subsequently, the recording material S is discharged onto a paper discharge tray.

Figure 2:
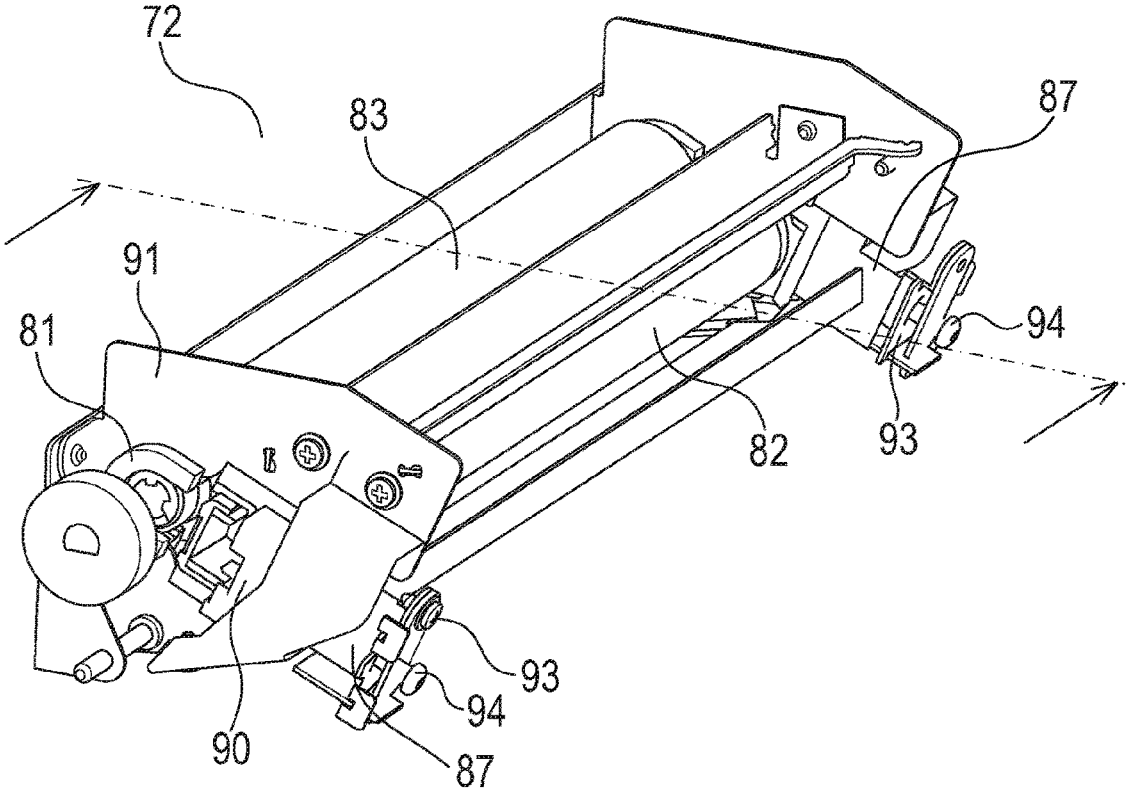
FIG. 2 is a perspective view of an image heating apparatus according to a first embodiment.
Figure 3:
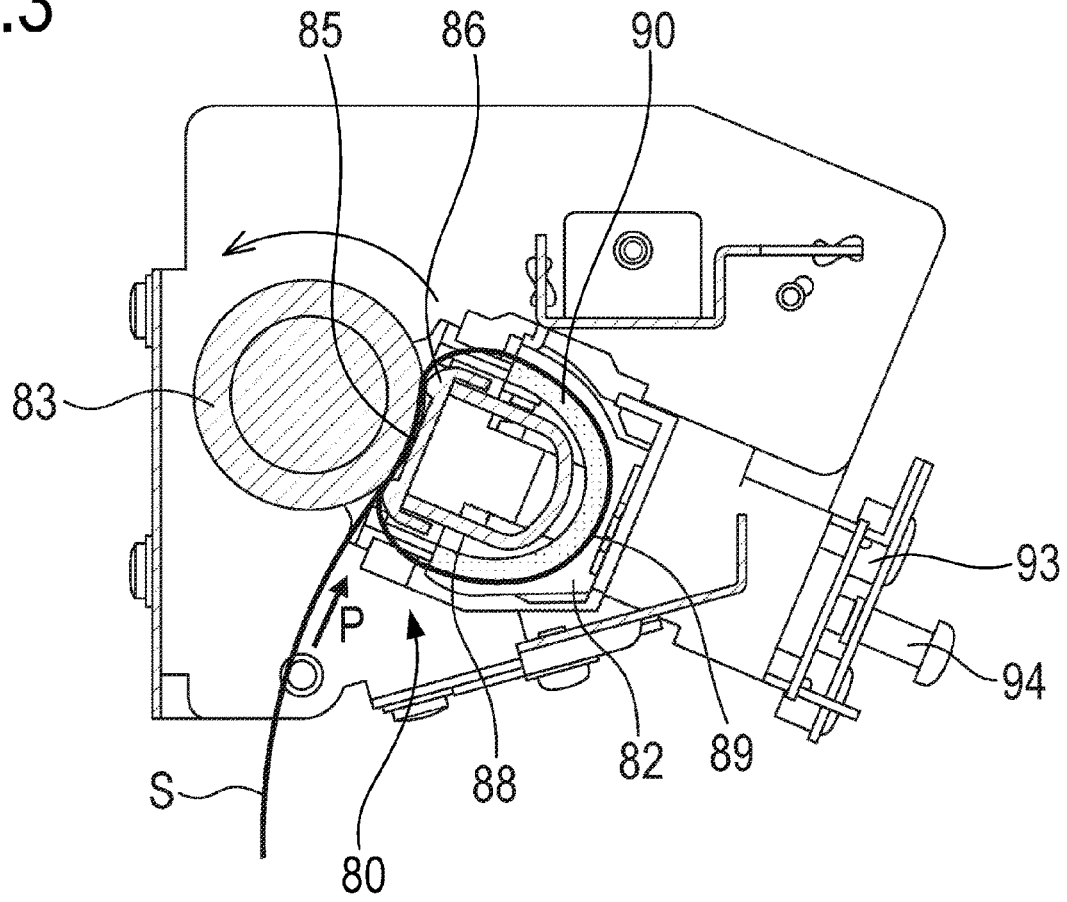
FIG. 3 is a sectional view of the image heating apparatus according to the first embodiment.
Figure 4:
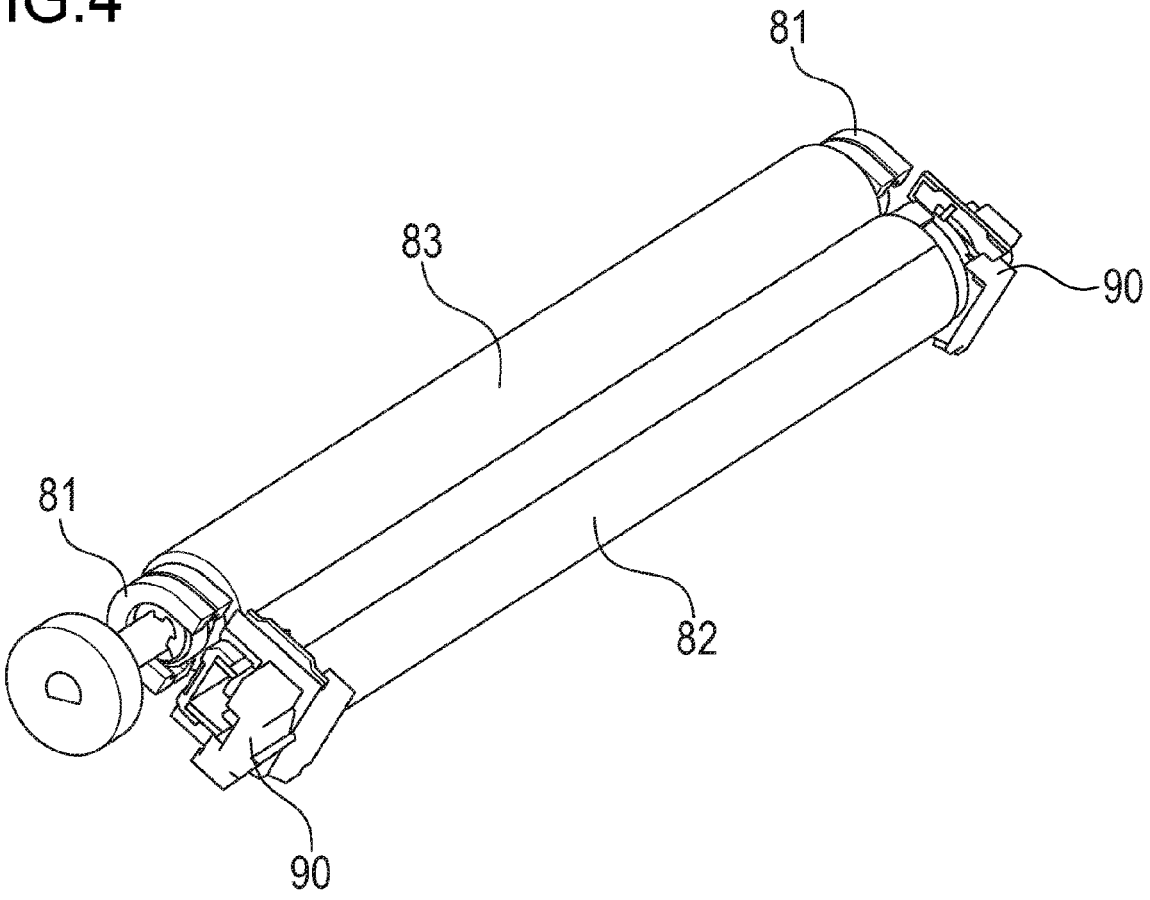
FIG. 4 is a perspective view of a roller pair of the image heating apparatus according to the first embodiment.

Next, the fixing apparatus 72 according to the present embodiment will be described with reference to FIGS. 2 to 4. FIG. 2 is a perspective view of the fixing apparatus 72 according to the first embodiment, FIG. 3 is a sectional view of the fixing apparatus 72 according to the first embodiment, and FIG. 4 is a perspective view of a fixing roller pair according to the first embodiment. The fixing apparatus 72 is a film heating system fixing apparatus which rotationally drives a pressure roller 83 and which causes a fixing film 89 that comes into pressure contact with the pressure roller 83 to be driven to rotate.

The fixing apparatus 72 has a supporting frame 91, a heating unit 82, and the pressure roller (the second rotating member) 83. The heating unit 82 has the fixing film (the first rotating member) 89 which has a cylindrical shape and which uses a metal such as SUS or a heat-resistant resin such as polyimide as a base layer. Reference numeral 85 denotes a ceramic heater which heats an inner surface of the fixing film 89. Reference numeral 86 denotes a heater supporting member made of a material with both heat-resistance and slidability such as a heat-resistant resin like liquid crystal polymer. Reference numeral 88 denotes a pressure stay which is made of metal to support the heater supporting member and supports the heating unit 82 being in pressure contact with the pressure roller 83. The ceramic heater 85, the heater supporting member 86, and the pressure stay 88 constitute the heater unit 80 which comes into contact with an inner surface of a film 202. The pressure roller 83 is in contact with the fixing film 89. The pressure roller 83 is an elastic roller in which an elastic layer made of silicone rubber is provided around a metallic core metal, and the pressure roller 83 is rotatably supported via a bearing 81 by the supporting frame 91 as the frame member. When a driving force is applied to the pressure roller 83 from a motor (not illustrated), the fixing film 89 is driven to rotate by a contact friction force between the pressure roller 83 and the fixing film 89.

Figure 5:
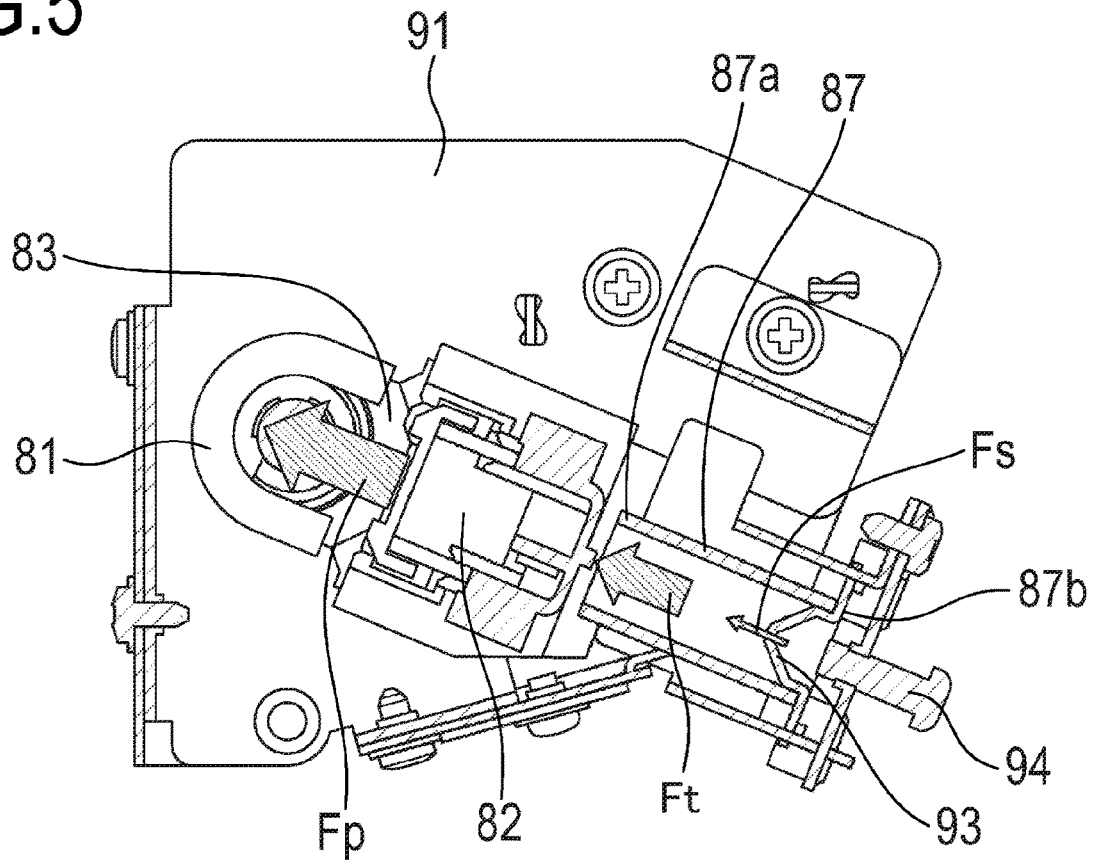
FIG. 5 is a sectional view for illustrating a pressurization mechanism according to the first embodiment.

Reference numeral 87 denotes a pressure spring (the biasing member) which is constituted by a compression spring (an elastic member) as an example of the elastic member and which applies a biasing force in order to bring the fixing film 89 into pressure contact with the pressure roller 83. The heating unit 82 is biased by the biasing force of the pressure spring 87 toward a side of the pressure roller 83 via a film flange 90 to be described later and the pressure stay 88 and, due to the force, a nip portion is formed between the fixing film 89 and the pressure roller 83. A position indicated by an arrow Ft in FIG. 5 represents a pressurization position of the film flange 90 by the pressure spring 87. The film flange 90 is a flange member which regulates an approaching movement in a bus direction during rotation of the fixing film 89 and a rotational axis position of an end portion of the film 89. The recording material S bearing a toner image is sandwiched and transported in a direction of an arrow P between the fixing film 89 having been heated by the ceramic heater 85 and the pressure roller 83, whereby the toner image is sufficiently heated and melted, flattened by nip pressure, and fixed to the recording material S.

Next, a pressurization configuration for pressurizing the heating unit 82 and the pressure roller 83 will be described in detail with reference to FIG. 5.

The heating unit 82 and the pressure roller 83 are held by the supporting frame 91 (the frame member) provided at both ends of the pressure roller 83 in an axial direction. The supporting frame 91 is provided with a guiding portion for guiding in a direction Fp in which the heating unit 82 pressurizes the pressure roller 83, and the pressure roller 83 is rotatably supported by the supporting frame 91 via the bearing 81. In order to bring the heating unit 82 into pressure contact with the pressure roller 83, pressurization is performed in a direction of the arrow Ft by the pressure spring 87. The pressure spring 87 has a first end portion 87*a* to be fixed to one end of the film flange 90 and a second end portion 87*b* that is another end.

Reference numeral 93 denotes a moving member which is provided on a side of the end portion 87*b* of the pressure spring 87 on an opposite side to the end portion 87*a* on a side of the film flange 90 provided with the fixing film 89, the moving member being provided so as to be movable in a biasing direction Fs of the pressure spring with respect to the supporting frame 91. In the present embodiment, the moving member 93 supports the pressure spring 87 in a state where the moving member 93 is lightly press-fitted into the second end portion 87*b*. Reference numeral 94 is an adjustment member which is movably fixed to the supporting frame 91 and which is used to determine a position of the moving member 93. A screw portion provided on a tip of the adjustment member 94 is fastened to a female screw portion provided on the supporting frame 91. In addition, in accordance with a degree at which the screw portion is fastened, the adjustment member 94 can be moved and fixed to an arbitrary position of the supporting frame 91 with respect to the biasing direction Fs.

Furthermore, by bringing a tip of the screw portion of the adjustment member 94 into contact with the moving member 93, the position of the moving member 93 in a movement direction is determined while the moving member 93 receives a biasing force of the pressure spring 87. In order to eliminate shift in a vertical direction relative to the biasing direction Fs described above as the movement direction, the moving member 93 is provided in a contact portion with the adjustment member 94 with a conically recessed shape (the conical shape) having, as a vertex, a center of a fixed shape that fixes a state where the moving member 93 is lightly press-fitted into the pressure spring 87. By bringing an inclined surface of the conically recessed shape of the moving member 93 into contact with the tip of the adjustment member 94 and bringing the adjustment member 94 into contact with the moving member 93 so that a center of the pressure spring 87 and a center of the adjustment member 94 match each other, a movement of the adjustment member 94 in a direction perpendicular to the movement direction of the moving member 93 is regulated. In other words, the contact portion between the moving member 93 and the adjustment member 94 in the biasing direction Fs is given a regulating shape that regulates relative movement of the moving member 93 and the adjustment member 94 in a direction perpendicular to the biasing direction Fs. As a result, the fixing film 89 included in the heating unit 82 can directly receive the biasing force of the pressure spring 87 and tilting of postures of the moving member 93 and the pressure spring 87 is eliminated. In addition, loss of the biasing force of the pressure spring 87 due to the parts coming into contact with the supporting frame 91 during biasing of the pressure spring no longer occurs. While the moving member 93 is given a conically recessed shape (the conical shape) in the present embodiment, the present invention is not limited thereto. In other words, the moving member 93 and the adjustment member 94 may be given shapes which fit into each other and which regulate a position of the adjustment member 94 in the vertical direction relative to the movement direction of the moving member 93. For example, a similar effect can be produced by giving one of the moving member 93 and the adjustment member 94 a recessed shape and giving the other a protruded shape that engages with the recessed shape such as making the shape of the adjustment member 94 a conically recessed shape which is contrary to the present embodiment.

The pressurization mechanism according to the present embodiment determines a position of the moving member 93 with respect to the supporting frame 91 by finely adjusting a fastening amount (a movement amount) of the adjustment member 94 so that the biasing force of the pressure spring 87 equals prescribed pressure. In other words, a compression amount of the pressure spring 87 is determined and a pressurization force is adjusted by finely adjusting the fastening amount (the movement amount) of the adjustment member 94. Note that hardness of the pressure roller 83, a dimension between the ceramic heater 85 of the heating unit 82 to a pressure spring biasing surface of the film flange 90 contain variability due to tolerance of the respective parts. Due to such variability, a position where the pressure spring 87 comes into contact with the supporting frame 91 varies among fixing apparatuses. Therefore, an adjustment of pressurization force adjustment must be measured in a state where the variability is contained and the pressurization force is desirably adjusted by monitoring pressure that is applied to the pressure roller bearing 81 which is directly subjected to nip pressure.

The pressurization mechanism described above is provided at both ends of the pressure roller 83 in a longitudinal direction as shown in FIG. 3 and a similar configuration is provided on an opposite side that is not depicted in FIG. 5.

Figure 6:
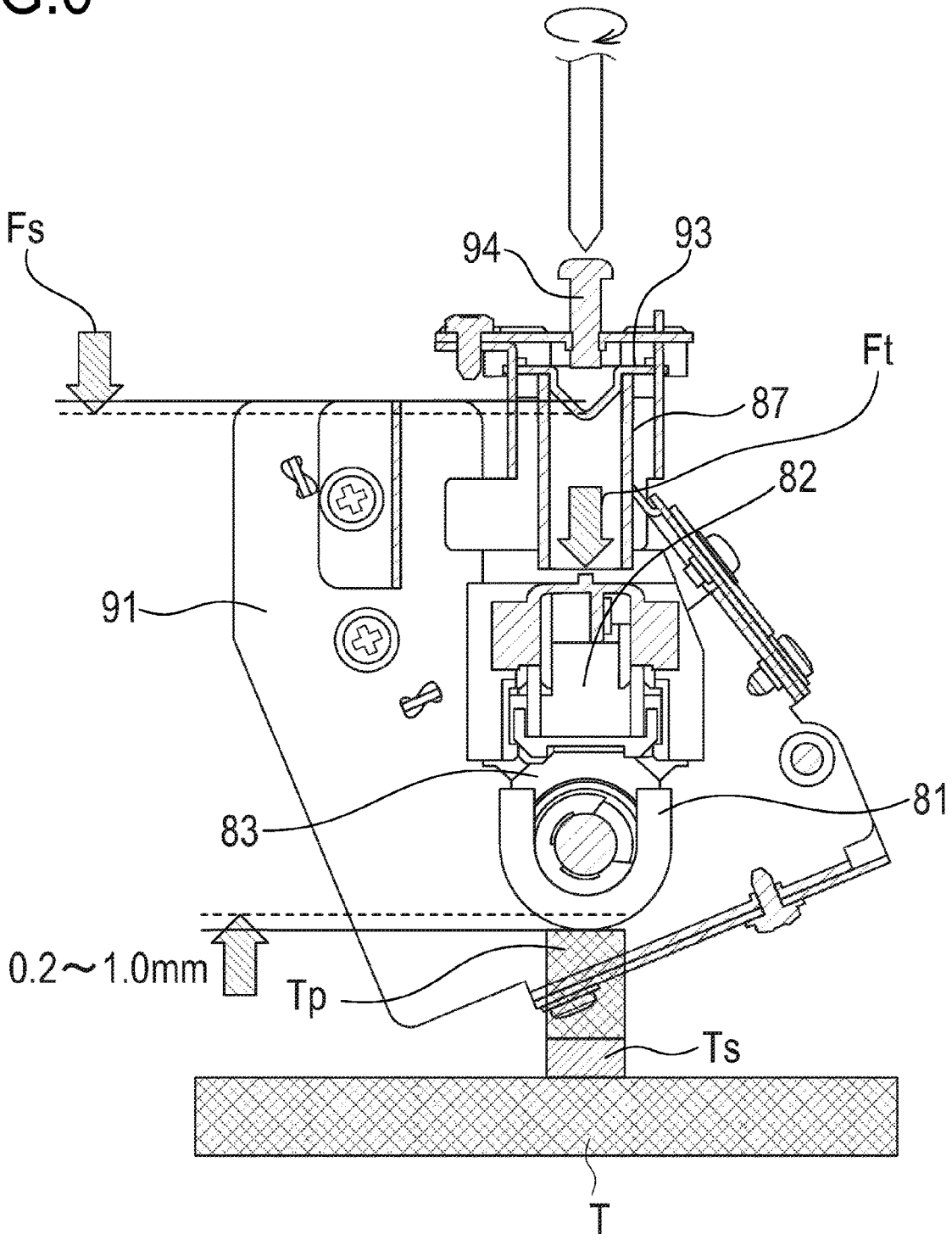
FIG. 6 is a sectional view for illustrating pressurization force adjustment according to the first embodiment.

Next, a method of adjusting the biasing force of the pressure spring 87 so as to equal prescribed pressure will be described with reference to FIG. 6. FIG. 6 represents a state prior to adjusting the biasing force of the pressure spring 87. The pressure spring 87 and the moving member 93 are installed on the supporting frame 91 and the adjustment member 94 is tentatively fastened to the supporting frame 91. First, using a tool T, the bearing 81 provided at both ends of the pressure roller 83 in the longitudinal direction are supported so that the bearing 81 is separated from the supporting frame 91 by 0.2 to 1.0 mm in a direction opposite to the direction Fp in which the heating unit 82 biases the pressure roller 83. Subsequently, the adjustment member 94 is fastened so as to approach the moving member 93. Upon conclusion of the fastening, the fastening operation is stopped at a position where the biasing force reaches set pressure while monitoring output of a pressure sensor Ts provided in a bearing supporting portion Tp of the tool T. At this point, the set pressure is set lower than the nip pressure in consideration of the amount by which the supported bearing 81 is separated from the supporting frame 91.

In this manner, positional adjustment can be performed by bringing the tip of the screw portion of the adjustment member 94 into contact with the conically recessed shape of the moving member 93 while measuring nip pressure with the tool T. As a result, tilting of the moving member 93 and the pressure spring 87 can be suppressed in a state where a biasing force is applied to the fixing film 89 of the heating unit 82. In addition, since a configuration is adopted in which these parts are less likely to be subjected to loads due to contact with other parts, loss of pressurizing force which accompanies adjustment can be suppressed and an adjustment to stable nip pressure can be made within a short period of time.

While the fixing apparatus 72 shown in FIG. 1 is configured such that the heating unit 82 is arranged on an upper side and the pressure roller 83 is arranged on a lower side, the fixing apparatus according to the present invention is not limited to such an arrangement. In other words, even when an arrangement configuration such as that shown in FIG. 3 is adopted, since a pressurization force is to be adjusted as shown in FIG. 6, a similar effect can be produced.

Second Embodiment

Figure 7:
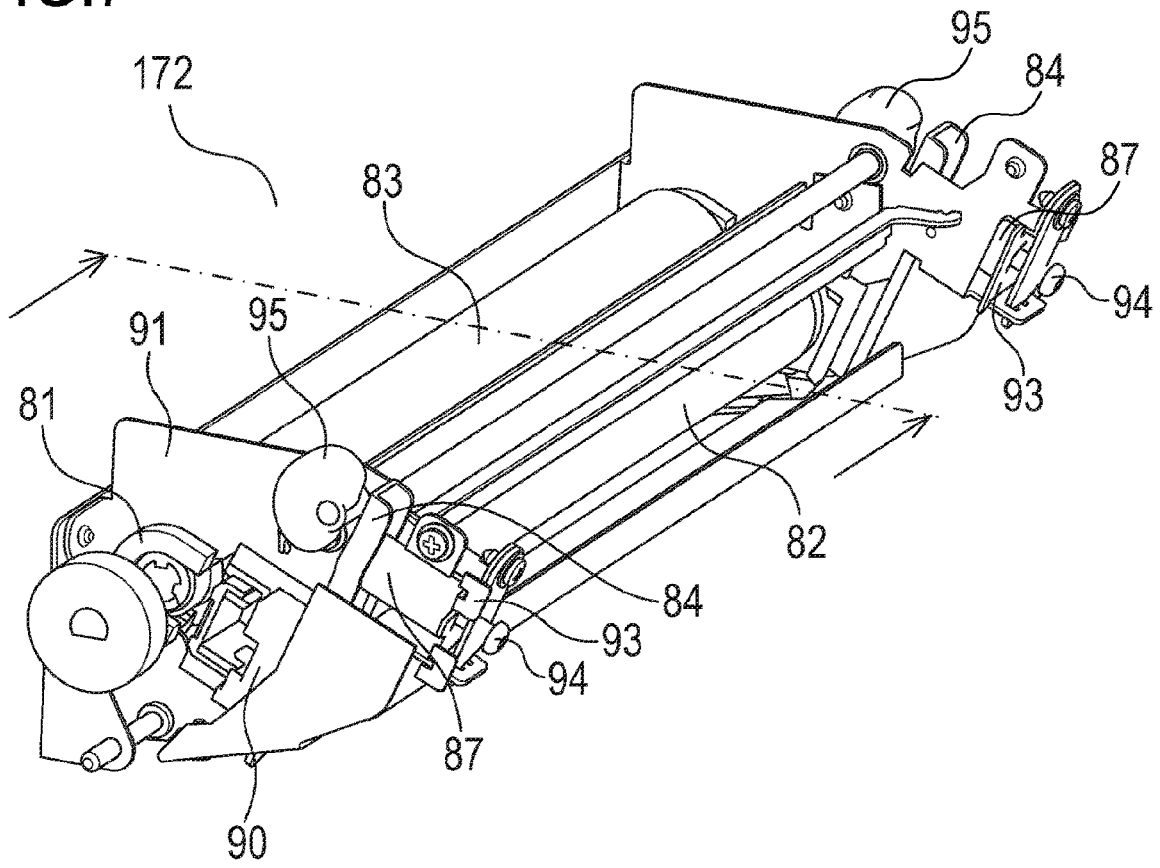
FIG. 7 is a perspective view of an image heating apparatus according to a second embodiment.
Figure 8:
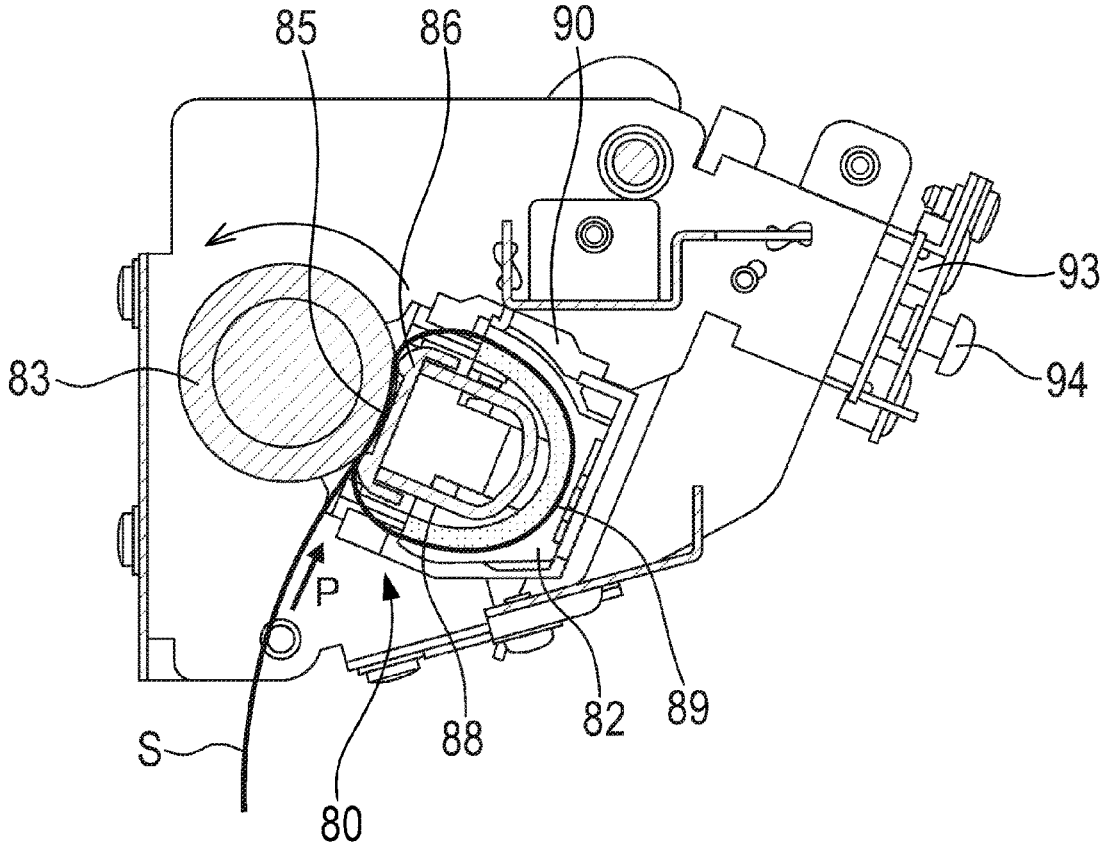
FIG. 8 is a sectional view of the image heating apparatus according to the second embodiment.
Figure 9:
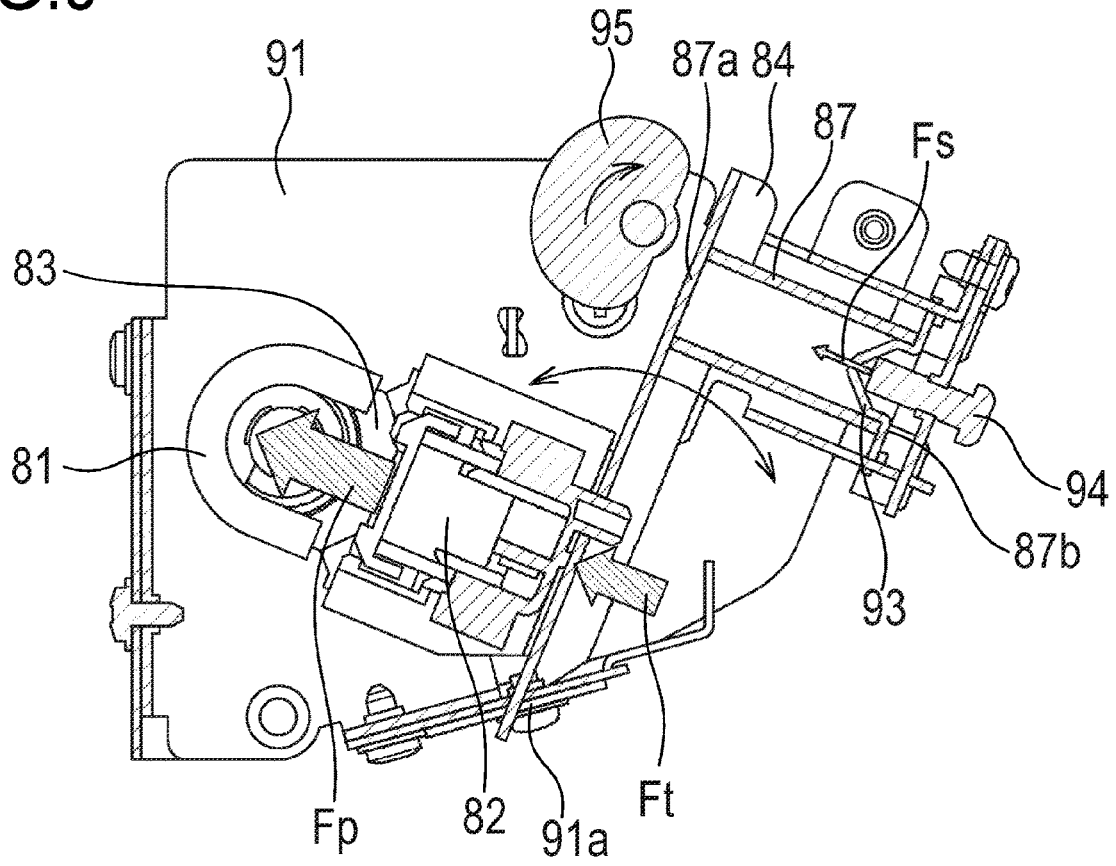
FIG. 9 is a sectional view for illustrating a pressurization mechanism according to the second embodiment.

Hereinafter, a second embodiment of the present invention will be described with reference to the drawings. A fixing apparatus 172 according to the second embodiment will be described with reference to FIGS. 7 to 9. Note that descriptions of portions that overlap with the first embodiment will be omitted. FIG. 7 is a perspective view of the fixing apparatus 172 according to the second embodiment, FIG. 8 is a sectional view of the fixing apparatus 172 according to the second embodiment, and FIG. 9 is a sectional view of a pressurization mechanism according to the second embodiment. Reference numeral 84 denotes a lever member which is rotatably provided with respect to the supporting frame 91 and which biases the fixing film 89 with respect to the pressure roller 83. As shown in FIG. 9, in the biasing direction Fs, the lever member 84 has a portion with which the pressure spring comes into contact and a portion which biases the fixing film 89 via the film flange 90 and the pressure stay 88. In addition, the lever member 84 has a shape that extends from the contact portion with the pressure spring 87 toward a side where the fixing film 89 is arranged. In other words, in the present embodiment, the portion where the lever member 84 comes into contact with the pressure spring 87 and the portion where the lever member 84 biases the fixing film 89 are arranged so as not to overlap with each other in the biasing direction Fs. Furthermore, the pressure spring 87 applies a biasing force to the film flange 90 via the lever member 84. In other words, the lever member 84 functions as a biasing force-transmitting member for transmitting the biasing force created by the pressure spring 87 to the fixing film 89. Due to the biasing force via the lever member 84, a nip portion is formed between the fixing film 89 and the pressure roller 83. A position indicated by the arrow Ft represents a pressurization position of the film flange 90 by the lever member 84. Reference numeral 95 denotes a cam member which, by acting on the lever member 84, releases or reduces pressure applied between the fixing film 89 and the pressure roller 83 due to the biasing force of the pressure spring 87. The release (reduction) of the nip pressure is performed by rotating the lever member 84 with the cam member 95 and causing the lever member 84 to separate from the fixing film 89. The pressure spring 87 has the first end portion 87*a* to be fixed to one end of the lever member 84 and the second end portion 87*b* that is another end.

Reference numeral 93 denotes a moving member which is provided on a side of the end portion 87*b* of the pressure spring 87 on an opposite side to the end portion 87*a* on a side of the lever member 84, the moving member being provided so as to be movable in the biasing direction Fs of the pressure spring with respect to the supporting frame 91.

In order to eliminate shift in a vertical direction relative to the biasing direction Fs described above as a movement direction, the moving member 93 is provided in a contact portion with the adjustment member 94 with a conically recessed shape (the conical shape) having, as a vertex, a center of a shape that fixes a state where the moving member 93 is lightly press-fitted into the pressure spring 87. Due to the conically recessed shape, the moving member 93 regulates a movement of the adjustment member 94 in a direction perpendicular to the movement direction of the moving member 93. In other words, in a similar manner to the first embodiment, the contact portion between the moving member 93 and the adjustment member 94 in the biasing direction Fs is given a regulating shape that regulates relative movement of the moving member 93 and the adjustment member 94 in a direction perpendicular to the biasing direction Fs. Accordingly, postures of the moving member 93, the pressure spring 87, and the lever member 84 are stabilized and tilting is eliminated, and loss of the biasing force of the pressure spring 87 due to the parts coming into contact with the supporting frame 91 during biasing of the pressure spring no longer occurs.

In addition, at least parts of the lever member 84, the pressure spring 87, the moving member 93, the adjustment member 94, and the cam member 95 are all arranged on an approximately straight line. As a result, since tilting of the parts is also absent when releasing nip pressure, loss of biasing force and abrasion of parts no longer occur even when pressure contact and pressure release operations are repetitively performed.

Figure 10:
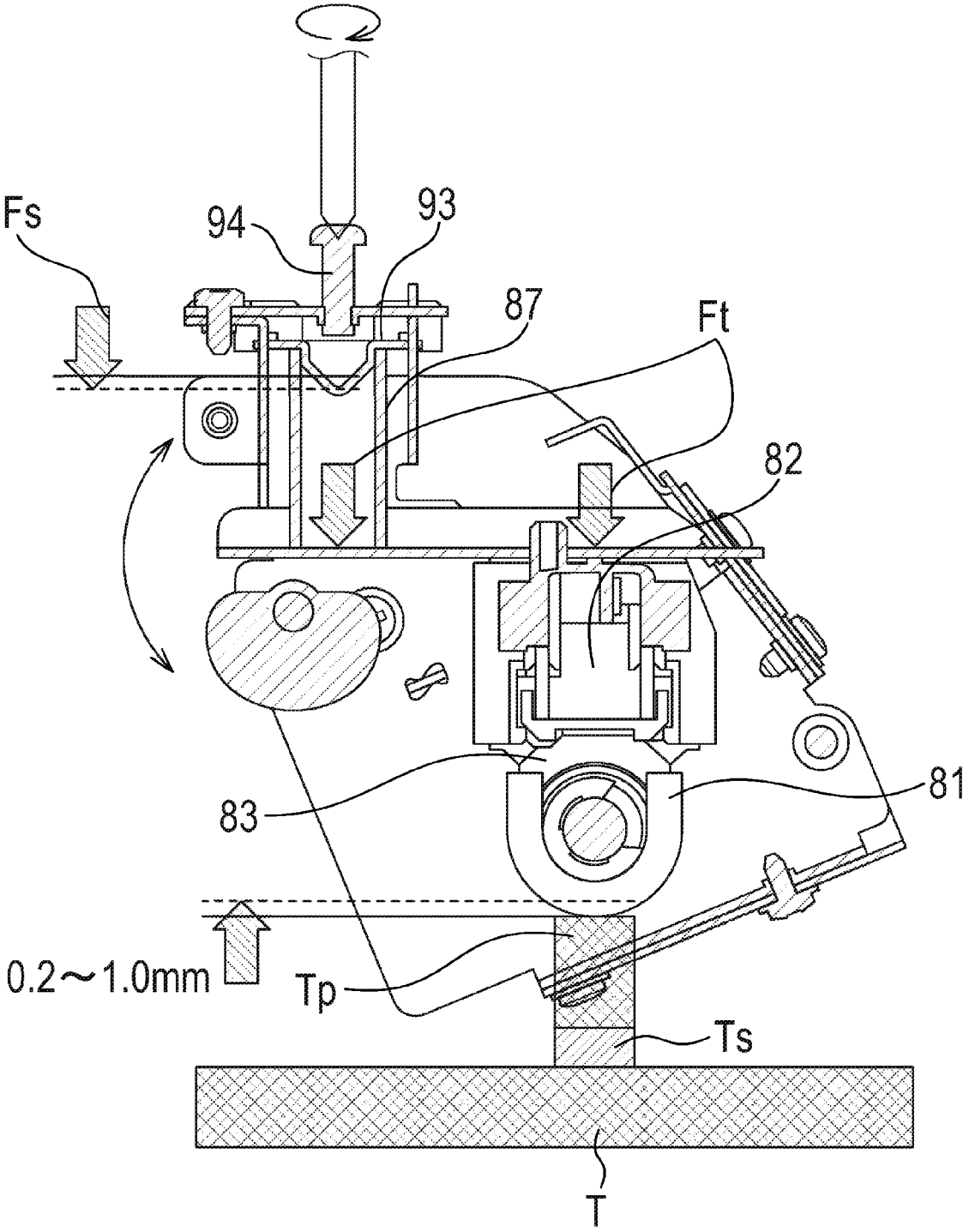
FIG. 10 is a sectional view for illustrating pressurization force adjustment according to the second embodiment.

Next, a method of adjusting the biasing force of the pressure spring 87 so as to equal prescribed pressure will be described with reference to FIG. 10. The pressure spring 87 and the moving member 93 are installed on the supporting frame 91 and the adjustment member 94 is tentatively fastened to the supporting frame 91. First, using the tool T, the bearing 81 provided at both ends of the pressure roller 83 in the longitudinal direction are supported so that the bearing 81 is separated from the supporting frame 91 by 0.2 to 1.0 mm in a direction opposite to the direction Fp in which the heating unit 82 biases the pressure roller 83. Subsequently, the adjustment member 94 is fastened so as to approach the moving member 93. Upon conclusion of the fastening, the fastening operation is stopped at a position where the biasing force reaches set pressure while monitoring output of the pressure sensor Ts provided in the bearing supporting portion Tp of the tool T.

In this manner, positional adjustment can be performed by bringing the tip of the screw portion of the adjustment member 94 into contact with the conically recessed shape of the moving member 93 while measuring nip pressure with the tool T. As a result, tilting of the moving member 93, the pressure spring 87, and the lever member 84 can be suppressed in a state where a biasing force is applied to the fixing film 89 of the heating unit 82. In addition, since a configuration is adopted in which these parts are less likely to be subjected to loads due to contact with other parts, loss of pressurizing force which accompanies adjustment can be suppressed and an adjustment to stable nip pressure can be made within a short period of time. Furthermore, unlike the first embodiment, the present embodiment is configured such that, by providing the lever member 84 between the pressure spring 87 and the heating unit 82 which includes the fixing film 89, the fixing film 89 is biased via the lever member 84. Accordingly, the fixing film 89 can be biased toward the pressure roller 83 even in an arrangement in which the pressure spring 87 for biasing the fixing film 89 and the fixing film 89 which is an object to be biased by the pressure spring 87 do not overlap with each other in the biasing direction. In addition, by providing the cam member 95, pressure applied between the fixing film 89 and the pressure roller 83 can be released or reduced while maintaining the biasing force of the pressure spring 87 which has been adjusted according to the method described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-107310, filed on Jun. 7, 2019, which is hereby incorporated by reference herein in its entirety.

What is claimed is:

1. An image heating apparatus that heats an image formed on a recording material, the image heating apparatus comprising:

a first rotating member;

a second rotating member which comes into contact with the first rotating member and which forms a nip portion that sandwiches the recording material between the first rotating member and the second rotating member;

a frame member which rotatably supports the second rotating member;

a biasing member constituted by an elastic member which biases the first rotating member toward the second rotating member;

a moving member which is provided so as to be movable in a biasing direction of the biasing member with respect to the frame member at an end portion of the biasing member on an opposite side to a side of an end portion of the biasing member where the first rotating member is arranged and which supports the biasing member; and an adjustment member which comes into contact with the moving member in the biasing direction and which is used to adjust a position of the moving member in the biasing direction with respect to the frame member, wherein a contact portion between the moving member and the adjustment member in the biasing direction has a regulating shape formed by at least a portion of the moving member and at least a portion of the adjustment member overlapping with each other in a direction perpendicular to the biasing direction to thereby regulate relative movement of the moving member and the adjustment member in the direction perpendicular to the biasing direction.

2. The image heating apparatus according to claim 1, wherein in the contact portion, one of the moving member and the adjustment member has a recessed shape and the other has a protruded shape that engages with the recessed shape.

3. The image heating apparatus according to claim 1, further comprising:

a biasing force transmitting member which is provided so as to be movable in the biasing direction with respect to the frame member between the biasing member and the first rotating member and which transmits a biasing force for the second rotating member to the first rotating member, wherein the biasing force transmitting member has a portion with which the biasing member comes into contact and a portion which biases the first rotating member, wherein the biasing force transmitting member is arranged so that a position of the portion with which the biasing member comes into contact and a position of the portion which biases the first rotating member do not overlap with each other in the biasing direction.

4. The image heating apparatus according to claim 3, further comprising:

a cam member, wherein the cam member acts on the biasing force transmitting member to separate the biasing force transmitting member from the first rotating member.

5. The image heating apparatus according to claim 4, wherein at least parts of the adjustment member, the moving member, the biasing member, the biasing force transmitting member, and the cam member are arranged in this order on an approximately straight line in the biasing direction in the image heating apparatus.

6. The image heating apparatus according to claim 1, wherein the regulating shape is a conical shape.

7. The image heating apparatus according to claim 1, wherein the first rotating member is a cylindrical film, wherein a heater unit including a heater that heats an image formed on the recording material is in contact with an inner surface of the film.

8. An image forming apparatus, comprising:

an image forming portion which forms an image on a recording material; and a fixing portion which fixes an image formed by the image forming portion to the recording material, wherein the fixing portion is the image heating apparatus according to claim 1.

9. An image heating apparatus that heats an image formed on a recording material, the image heating apparatus comprising:

a first rotating member;

a second rotating member which comes into contact with the first rotating member and which forms a nip portion that sandwiches the recording material between the first rotating member and the second rotating member;

a frame member which rotatably supports the second rotating member;

a biasing member constituted by an elastic member which biases the first rotating member toward the second rotating member;

a moving member which is provided so as to be movable in a biasing direction of the biasing member with respect to the frame member at an end portion of the biasing member on an opposite side to a side of an end portion of the biasing member where the first rotating member is arranged and which supports the biasing member; and an adjustment member which comes into contact with the moving member in the biasing direction and which is used to adjust a position of the moving member in the biasing direction with respect to the frame member, wherein a contact portion between the moving member and the adjustment member in the biasing direction has a regulating shape that regulates relative movement of the moving member and the adjustment member in a direction perpendicular to the biasing direction, and wherein in the contact portion, one of the moving member and the adjustment member has a recessed shape and the other has a protruded shape that engages with the recessed shape.

10. The image heating apparatus according to claim 9, wherein the first rotating member is a cylindrical film, and wherein a heater unit including a heater that heats an image formed on the recording material is configured to contact an inner surface of the film.

11. An image heating apparatus that heats an image formed on a recording material, the image heating apparatus comprising:

a first rotating member;

a second rotating member which comes into contact with the first rotating member and which forms a nip portion that sandwiches the recording material between the first rotating member and the second rotating member;

a frame member which rotatably supports the second rotating member;

a biasing member constituted by an elastic member which biases the first rotating member toward the second rotating member;

a moving member which is provided so as to be movable in a biasing direction of the biasing member with respect to the frame member at an end portion of the biasing member on an opposite side to a side of an end portion of the biasing member where the first rotating member is arranged and which supports the biasing member; and an adjustment member which comes into contact with the moving member in the biasing direction and which is used to adjust a position of the moving member in the biasing direction with respect to the frame member, wherein a contact portion between the moving member and the adjustment member in the biasing direction has a regulating shape that regulates relative movement of the moving member and the adjustment member in a direction perpendicular to the biasing direction, and wherein the regulating shape is a conical shape.

12. The image heating apparatus according to claim 11, wherein the first rotating member is a cylindrical film, and wherein a heater unit including a heater that heats an image formed on the recording material is configured to contact an inner surface of the film.

* * * * *